United States Patent [19]

Strobel

[11] 3,966,191

[45] June 29, 1976

[54] SHEET SEPARATING DEVICE

[75] Inventor: Harry Strobel, Berlin, Germany

[73] Assignee: Pitney-Bowes, Inc., Stamford, Conn.

[22] Filed: Apr. 16, 1975

[21] Appl. No.: 568,589

[30] Foreign Application Priority Data

Apr. 25, 1974 Germany ..... 2420078

[52] U.S. Cl. ..... 271/125; 271/37; 271/117

[51] Int. Cl.[2] ..... B65H 3/06

[58] Field of Search ..... 271/10, 34, 37, 109, 271/114, 117–119, 121, 125, 126

[56] References Cited

UNITED STATES PATENTS 3,059,922 10/1962 Marshall ..... 271/125

OTHER PUBLICATIONS

IBM Technical Disclosure Bulletin, Foam Document picker vol. 13, No. 2, Towne et al., July 1970.

IBM Technical Disclosure Bulletin, Document Picker Cam, vol. 11, No. 11, Maliwacki, Apr. 1969.

*Primary Examiner*—Evon C. Blunk
*Assistant Examiner*—Robert Saifer
*Attorney, Agent, or Firm*—Peter Vrahotes; William D. Soltow, Jr.; Albert W. Scribner

[57] ABSTRACT

A sheet separating device is disclosed for separating a single sheet from a stack of sheets in an inclined supply hopper of a document feeder or the like. Spaced drive rollers are located above the stack and are operative to engage the uppermost sheet of the stack. During rotation of the drive roller, the sheets are separated one at a time from the stack and are fed to a work station, for instance, a printing station. Means is provided for equalizing the pressure of the separator upon the stack of sheets as its height decreases.

8 Claims, 2 Drawing Figures

SHEET SEPARATING DEVICE

BACKGROUND OF THE INVENTION

In well known sheet separating devices, as exemplified in German Pat. DT-AS 1 611 372, the upstream roller as well as the downstream roller, relative to the sheet conveying direction, both have a concentric configuration and continuously contact the sheet directly beneath them. A jam inhibitor is generally associated with the downstream separator roller. The jam inhibitor is made of a soft rubber material and fixed to the supply hopper. It enables sheets having different thickness and characteristics to be processed without the risk that two or more sheets being simultaneously engaged and propelled.

Experience has shown, however, that engaging and separating of the uppermost sheet of a stack of sheets is not performed with desired regularity, as for example, the feeding of envelopes or documents to a printing station wherein an imprint has to be made upon a precise predetermined area. Factors which can effect the regularity are, for instance, the differing quantity of the sheets in the stack of sheets, their differing "fanning out" properties, their varying angle to the horizontal, and, not least, the dissimilar adhesion values and stiffnesses. The object of this invention is to provide an improved sheet separating device of the type described before which avoids the above disadvantages and which attains a simple performance that guarantees an accurate separation of the sheets to be fed independent of their properties, sizes and characteristics.

SUMMARY OF THE INVENTION

The sheet separating device according to the invention includes an auxiliary separator roller, arranged upstream from the separator roller. The auxiliary separator roller is eccentrically mounted above the downstream end of a hopper which is adapted to receive a stack of sheets. The eccentric mounting of the auxiliary separator roller ensures that the uppermost sheet, whose front edge is already located in front of the separator roller, will be engaged and propelled to the separator roller. The perimeter of the separator roller achieves a virtually swinging contact with the stack of sheets through which a rhythmical increasing and decreasing feed is attained. In this way, an allowance is made for differences in properties of the sheets as well as the differing height of the stack, the relative position of the sheets within the stack, and, as to the separator roller, the differing adhesion values, stiffnesses or the like.

It has been found advantageous to provide an embodiment in which the auxiliary separator roller has two rings made out of soft rubber material or the like on its perimeter. These rings easily can be mounted on the hard cylindric core of the roller and have proven to be very tractive. The frictional characteristics are further enhanced by radially extending notches in the rings of the auxiliary separator roller.

The auxiliary separator roller is connected to the powered separator roller by means of a belt or the like. There is no need of an additional intermediate supplementary roller contacting the surface of both the separator rollers.

A suitable construction for mounting the belt involves providing a circumferential groove on the auxiliary roller. Specifically, the separator roller is provided with two rings made out of rubber material, or the like, notched at their circumferences and spaced from each other to define a roller section with the circumferential groove therebetween.

Through a very simple and yet functional manner with regard to the effective construction, it has been found advantageous if a spring load on the auxiliary separator roller is attained in such a way that the auxiliary separator roller is pivoted so as to be movable towards and away from the stack of sheets. The auxiliary separator roller is mounted on a shaft which is parallel to a pivot shaft which is received mounted in the side walls of the housing of the sheet separating device. A spring acts upon the rollers to determine the pressure applied to the stack of sheets.

DESCRIPTION OF THE PREFERRED EMBODIMENT

Figure 1:
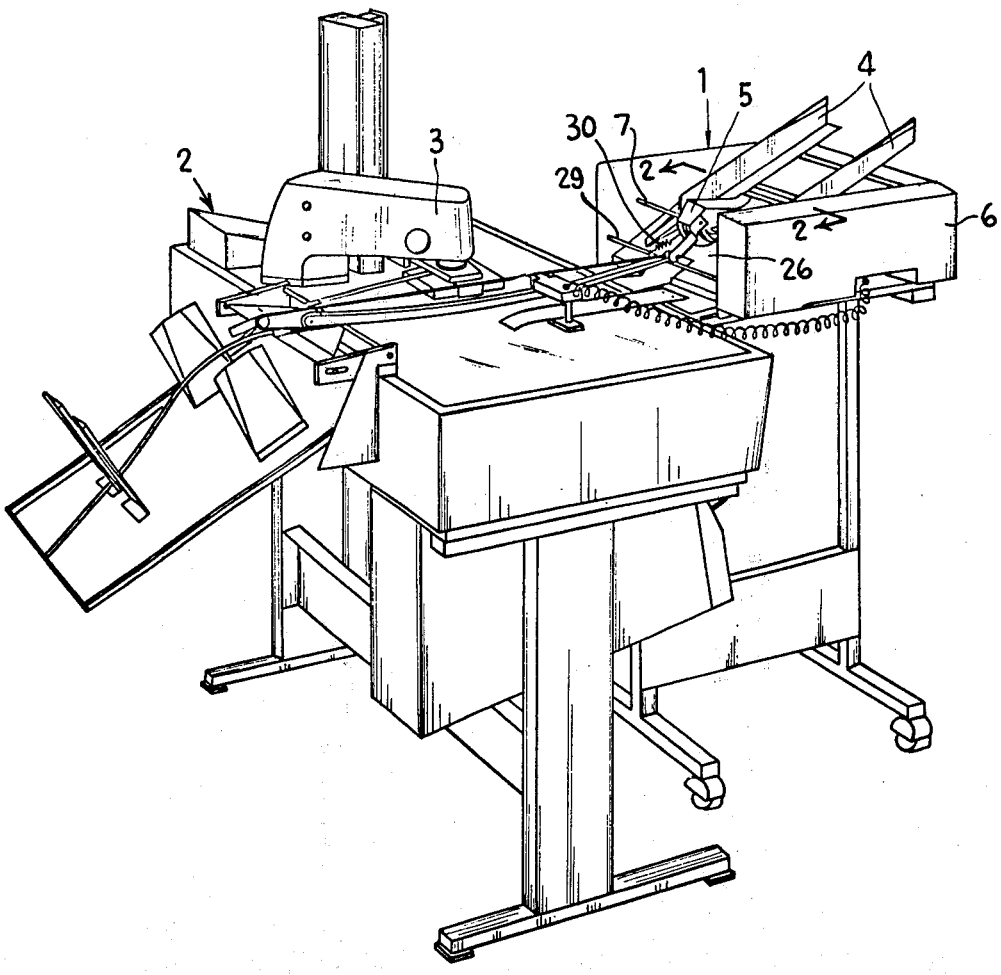
FIG. 1 is a perspective view of a document feeder incorporating the principles of the instant invention which is operatively connected to an address printing machine.

As shown in FIG. 1, a portable document feeder is shown generally at 1 which, as the need arises, can be moved to an operating machine, as for example, to an address printing machine 2 and can be connected to it in a way such that its rate of operation is controlled by the machine.

Figure 2:
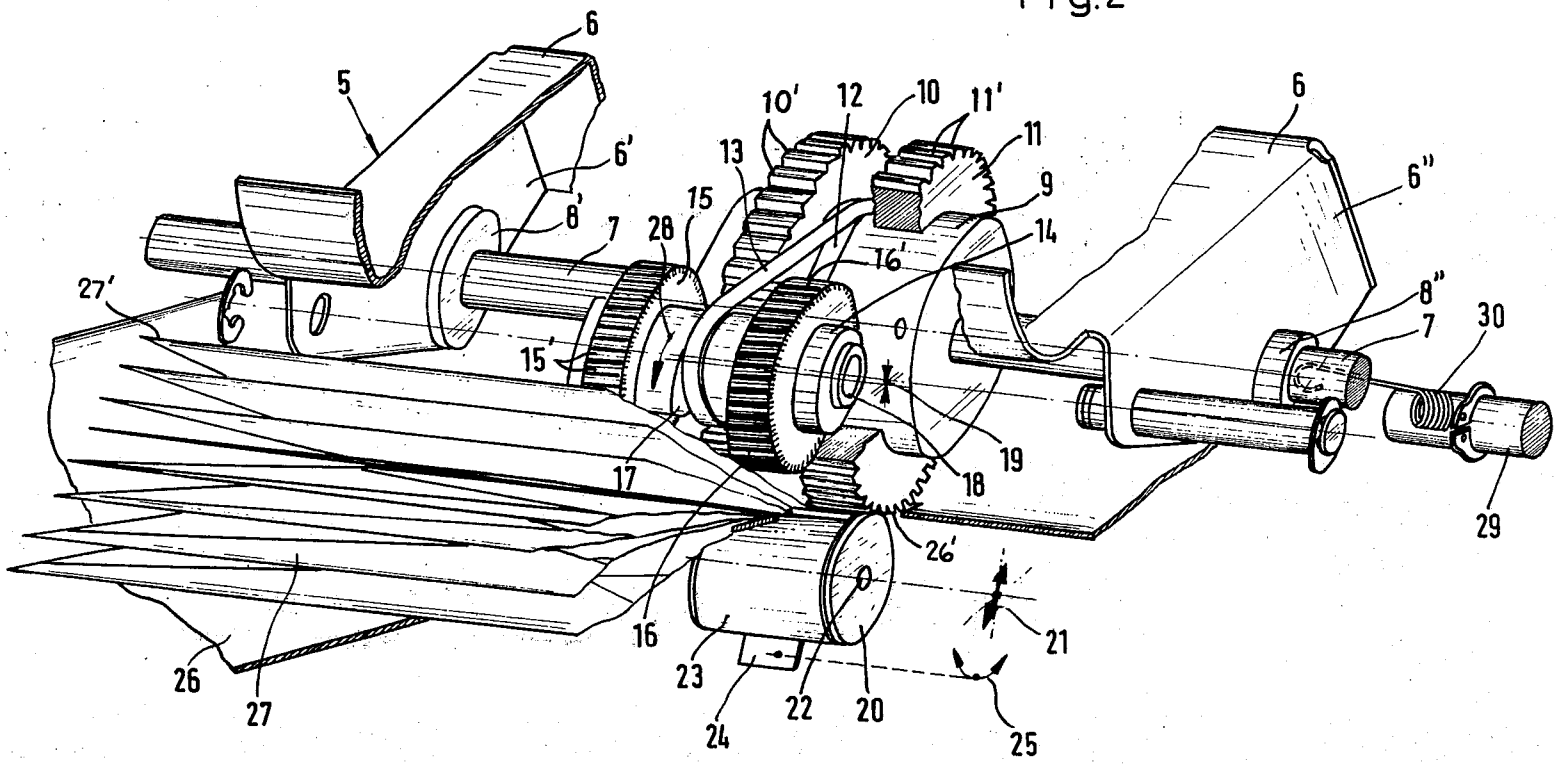
FIG. 2 is an enlarged, partial perspective view of the document feeder of FIG. 1 taken along the line 2—2 and having cut-out portions for purposes of clarity.

The material to be printed may be of different types with different characteristics, i.e., sheets in the form of documents or the like, which have different thicknesses and sizes. The printing station includes a printing head 3 located within the address printing machine 2. The document feeder 1 is provided with a stack of sheets 27 inserted between two side guides 4. In order to convey individually the material to be printed, the document feeder 1 is provided with a sheet separating device 5 located intermediate the side guides 4. The particular embodiment of this separating device 5 is shown in detail in FIG. 2.

The sheet separating device 5 comprises a housing 6 having side walls 6′, 6″. Received within each of the side walls 6′, 6″ is a bearing 8′ and 8″, respectively through which a shaft 7 is journalled. As is apparent from FIG. 2, the outside ends of the shaft 7 extend beyond the sides of the document feeder 1. A separator roller 9 is mounted on the shaft 7 for rotation therewith and comprises two rings 10, 11, consisting of rubber material or the like, having radial notches 10′, 11′ at their circumferences. These two rings 10, 11 are spaced a distance from each other, thus defining a circumferential groove 12 adapted to receive an O ring type belt 13. This belt 13 serves as a drive connection between an auxiliary separator roller 14 and the separator roller 9. An auxiliary separator roller 14 is mounted upon a shaft 18 that extends through the side walls 6′, 6″. Two rings 15, 16 are disposed about the perimeter of the auxiliary roller 14 and consist of soft rubber material or the like. For this purpose, the auxiliary separator roller 14 also is provided with a circumferential groove 17 in the area between the rings 15, 16. The circumference groove 17 receives the belt 13 and has a variable depth to provide an eccentric drive to the auxiliary separator roller 14 as indicated by 19.

Beneath the separator roller 9 and in operative engagement with the rings 10 and 11 is a cylindrical separator stone 20 which is mounted on a shaft 22. The shaft 22 is adjustably movable as indicated by the arrow 21, in order to vary the distance between the rings 10 and 11 and the separator stone or friction wheel 20. The separator stone 20 has a partialcylindrical cover 23 also mounted (by means not shown) on the shaft 22 which is adjustable in the direction of the arrows 25 by means of an adjustment handle 24. Thus, a variable amount of the separator stone 20 may be exposed in the area of the slot between the rings 10 and 11 and the separator stone 20 by adjusting the cover sheet 23.

As shown in FIG. 1, the sheet separator device 5 is arranged above an inclined supply hopper 26 which has a cut-out 26' in the area of the separator stone 20 through which the separator stone 20 partially extends. On the supply hopper 26, the stack of sheets 27 to be separated is stored, the stack consisting of fanned out envelopes in the embodiment shown in FIG. 2.

The rings 15, 16 of the auxiliary separator roller 14 rest upon the stack of sheets 27 and engage the uppermost sheet 27'. When the rings 15, 16 are rotating in the direction of the arrow 28 they propel the uppermost sheet 27 to the separator roller 9 where it engages the rings 10, 11. In order to increase the traction of the rings 15, 16, they are provided with radial notches 15', 16', respectively.

A shaft 29 is provided a distance downstream from the sheet separating device 5, as seen in FIG. 1, which, like the shaft 7, extends between the sides of the document feeder 1. A tension spring 30 is disposed about the shaft 29, having one end held by a retaining ring and the other end secured to a hook arranged on the side wall 6'' of the housing 6 of the sheet separating device 5. As the housing 6, together with its shaft 18 and the auxiliary separator roller 14 mounted thereon, is pivoted about the shaft 7 downwardly the tension spring 30 will act on the housing 6 at a location adjacent the shaft 7 and will determine the pressure with which the auxiliary separator roller 14 with its rings 15, 16 engages the stack of sheets 27. The effective direction of the spring 30 and its dimension is so selected that the pressure of the auxiliary separator roller 14 with its rings 15, 16 approaches zero when the housing 6 is shifted around the shaft 7 from the inclined position into the horizontal position. As the stack of sheets 27 becomes lower, the housing 6 with the auxiliary separator roller 14 is inclined toward the stack of sheets 27 and, based on its more effective weight directly bearing on the stack, would cause too great a pressure on the stack if the tension spring 30 would not compensate this. The tension spring therefore, avoids streamfeeding in this case, i.e. prohibits the propelling of too many sheets with the danger of overlapping the sheets during their feeding. Therefore, the tension spring 30 is selected so as to have the characteristic, that the torque affect on the stack of sheets 27 is the greatest when the stack is high and is the slightest in the case the stack is low. The tension spring 30 therefore, compensates for increased torque based on the weight of the housing 6.

What is claimed is:

1. A document feeder for supplying documents, one at a time, to a working station, the combination comprising: a support member, a sheet hopper disposed upon said support member, a housing having vertically extending walls pivotably supported by said support member, said vertically extending walls being located above said sheet hopper, a first shaft rotatably received within said housing and having a first roller mounted thereon, said first roller having a circumferential groove located therein, a friction wheel rotatably supported within said housing in operative engagement with said first roller, a second shaft having a second roller rotatably mounted thereon, said second roller being located above said supply hopper and having a circumferential eccentric groove disposed therein, said first roller being disposed intermediate said second roller and the working station, a belt received within said grooves, and a tension spring secured to said housing and to said support member.

2. A sheet separator device for feeding sheets individually from a stack of sheets, located within a hopper having side walls, to an addressing machine, the combination comprising:

A. a first shaft supported by the side walls of the hopper;

B. a housing pivotably supported by said first shaft;

C. a separator roller located within said housing and rotatably mounted on said first shaft;

D. a second shaft received within said housing, said second shaft being spaced from said first shaft;

E. an auxiliary roller received within said housing and rotatably mounted on said second shaft;

F. a third shaft disposed within said housing spaced relative to said first shaft;

G. a friction wheel rotatably mounted on said third shaft in operational engagement with said separator roller; and H. a tension biasing member associated with one of the side walls of the hopper and having one end engaging said housing, said spring being positioned to exert a tension upon said housing.

3. The device of claim 2 wherein said biasing member is a tension spring having one end mounted on said first shaft and the opposite end mounted on said housing.

4. The device of claim 2 wherein said rollers have resilient material about the perimeters thereof.

5. The device of claim 4 wherein the outer surfaces of said resilient material are notched.

6. The device of claim 2 wherein said separator roller comprises two adjacent rings having a grooved connecting member therebetween, said auxiliary separator comprises two adjacent rings having an eccentrically grooved member therebetween and a drive belt is received within said grooves of said connecting members.

7. The device of claim 6 wherein said rings have notched resilient material about the perimeters thereof.

8. The device of claim 6 including means for adjusting the space between said separator roller and said friction wheel.

* * * * *

UNITED STATES PATENT OFFICE

CERTIFICATE OF CORRECTION

Patent No. 3966191 Dated June 29, 1976

Inventor(s) Harry Strobel

It is certified that error appears in the above-identified patent and that said Letters Patent are hereby corrected as shown below:

Title page, column 1, line 3, change "[73] Assignee: Pitney-Bowes, Inc., Stamford, Conn." to --[73] Assignee: Adrema Pitney Bowes GmbH, Heppenheim, W. Germany--.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*